US006006494A

United States Patent [19]

Zaniboni

[11] Patent Number: 6,006,494

[45] Date of Patent: Dec. 28, 1999

[54] CLOSING DEVICE FOR BOOK-LIKE CONTAINERS

[75] Inventor: Carlo Zaniboni, Castenaso, Italy

[73] Assignee: Gima S.P.A., Italy

[21] Appl. No.: 09/072,465

[22] Filed: May 5, 1998

[51] Int. Cl.[6] ..... B65B 7/00

[52] U.S. Cl. ..... 53/376.3; 53/378.3; 53/387.2

[58] Field of Search ..... 53/484, 55, 58, 53/376.3, 377.6, 378.3, 382.2, 387.2

[56] References Cited

U.S. PATENT DOCUMENTS

| | | | |
|---|---|---|---|
| 2,311,017 | 2/1943 | Anderson | 53/376.3 |
| 2,842,920 | 7/1958 | Carkhuff et al. | 53/377.6 |
| 4,312,171 | 1/1982 | Vadas | 53/432 |
| 5,177,936 | 1/1993 | Myers et al. | 53/377.6 |
| 5,341,621 | 8/1994 | Martelli | 53/377.6 |
| 5,448,876 | 9/1995 | Menayan | 53/585 |
| 5,664,405 | 9/1997 | Perego | 53/376.3 |

FOREIGN PATENT DOCUMENTS

| | | | |
|---|---|---|---|
| 961017 | 1/1975 | Canada | 53/376.3 |
| 275368 | 1/1990 | Germany | 53/376.3 |
| 171609 | 6/1994 | Japan | 53/377.6 |

*Primary Examiner*—Eugene L. Kim
*Attorney, Agent, or Firm*—Nims, Howes, Collison Hansen & Lackert

[57] ABSTRACT

A closing device for book-like containers, with each container formed by a base and a cover of complementary shape hinged to the base along an edge, includes a first unit in which a grip is operated along a circular path coaxial with the hinge edge of a container situated below, while activation means and deactivation means open and close the grip. A second unit, situated downstream of the first unit is provided for snap-closing the covers of the containers.

8 Claims, 4 Drawing Sheets

FIG. 1
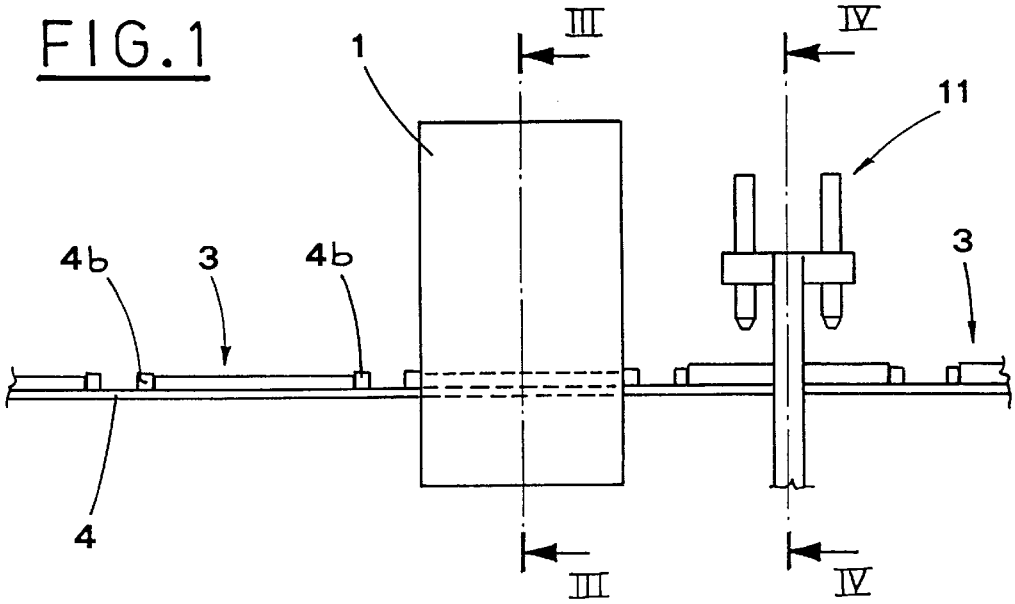
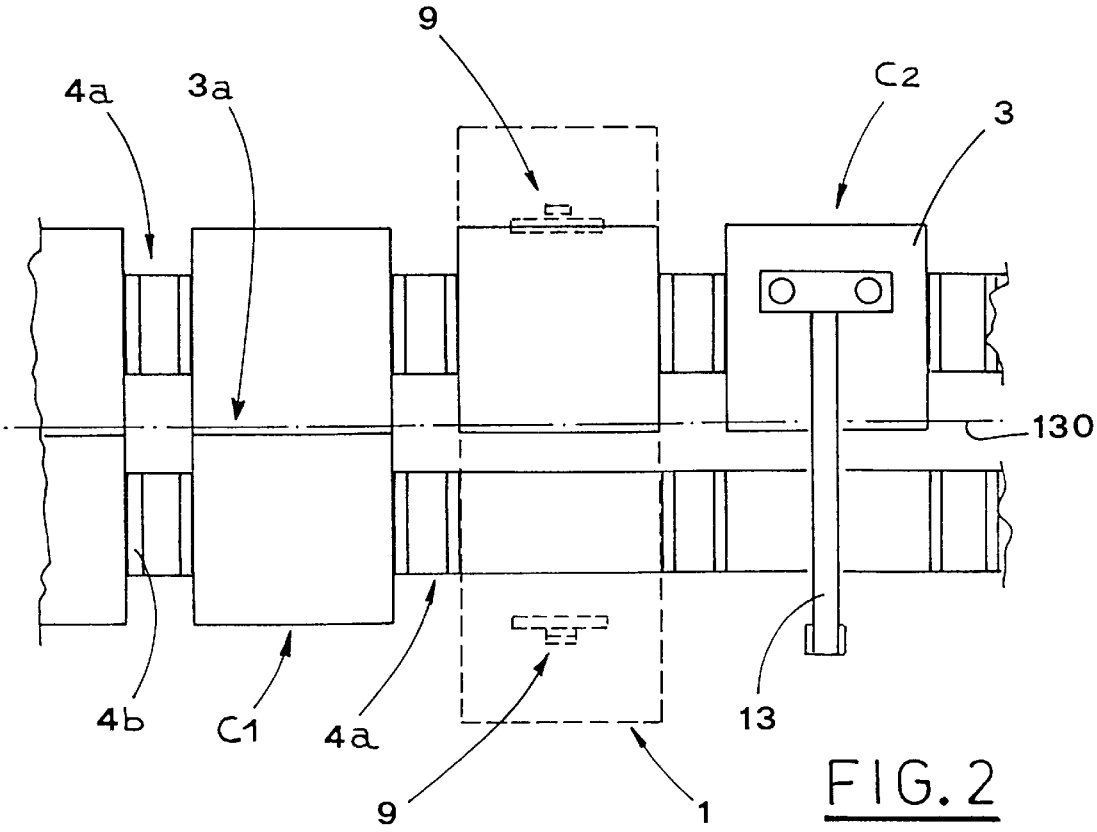
FIG. 2

CLOSING DEVICE FOR BOOK-LIKE CONTAINERS

FIELD OF THE INVENTION

The invention relates generally to a machine for handling containers, preferably book-like containers for CD, wherein CD containers are advanced along a conveyor for being filled, closed and packaged. In particular, the invention concerns a device for closing the CD containers.

BACKGROUND OF THE INVENTION

Compact discs, widely known as CDs, are usually packed into containers formed by two shells of plastic material, usually transparent. The shells are hinged together along a common edge.

While a first shell forms a bottom of the container and is shaped substantially like a box, a second shell has a shape complementary to the shape of the first shell, and forms a cover for the container.

Usually, closing devices for the (D containers are situated on a conveying line along which the containers are supplied with necessary contents e.g.: graphic leaflets, informative leaflets, sound medium, gadgets, etc.

Conventional devices for closing these shells are currently made of movable plates, which are suitably pivoted to a support structure so as to strike the cover shell thus making it close the related book-like container.

The most important disadvantages of these known devices derive from mechanical resistance required for the initial and final impacts imparted to the cover shell and the hinge around which the cover is rotated and overturned. Moreover, free rotation brings about possible unstability conditions.

The cover shell is moved in uncontrolled, random way, what provokes considerable mechanical stresses and "bounce effect" on the cover when it is struck by the movable plate as well as when it gets completely closed.

Moreover, closing steps, including a partial closing step and snap locking closing step, require considerably long time.

SUMMARY OF THE INVENTION

The object of the present invention is to provide a closing device for book-like containers, which is capable of avoiding the above mentioned problems, and provides closing steps in which the cover is always kept firmly guided thus avoiding possible unstability conditions.

Another object of the present invention is to propose a device which considerably increases production capacity, at the same time avoiding hard mechanical stresses and "bounce effects".

Yet another object of the invention is to propose a device which is simple, extremely reliable, functional and cheap to produce.

A further object of the invention is to provide a device which can optimize closing and subsequent packaging of containers, in particular CD containers.

The above mentioned objects are obtained, in accordance with the contents of the claims, by means of a closing device for book-like containers, with each container formed by a base and a cover having shape complementary to said base, said cover being hinged to said base along an edge thereof so as to define a hinge axis, said containers being advanced stepwise in open configuration in a forward direction along a conveying line with the hinge axes aligned and parallel to said forward direction, said closing device including:

a first unit for partially closing said containers, said first unit including gripping means, operated over said conveying line in time relation with the advancement thereof, over a circular path coaxial with the hinge axis of a container situated below and oriented so that closing rotation of the related said cover coincides with rotation direction of said gripping means;

activation means located in a gripping position for closing said gripping means to make them engage an outer edge of said cover;

deactivation means located in a release position for opening said gripping means and release said outer edge of said cover in a position near to the related said base, to obtain a container partially closed;

a second unit situated downstream of said first unit for snap-closing said containers partially closed coming from said partial closure unit.

BRIEF DESCRIPTION OF THE DRAWINGS

The characteristic features of the invention will be pointed out in the following description of a preferred, but not limitative embodiment, with reference to the enclosed drawings, in which:

FIG. 1 is a schematic lateral view of the proposed device;

FIG. 2 is a schematic plan view of the same device;

DESCRIPTION OF THE PREFERRED EMBODIMENT

With reference to the above mentioned figures, a first unit for partial closing of containers 3 is indicated with 1.

Figure 3A:
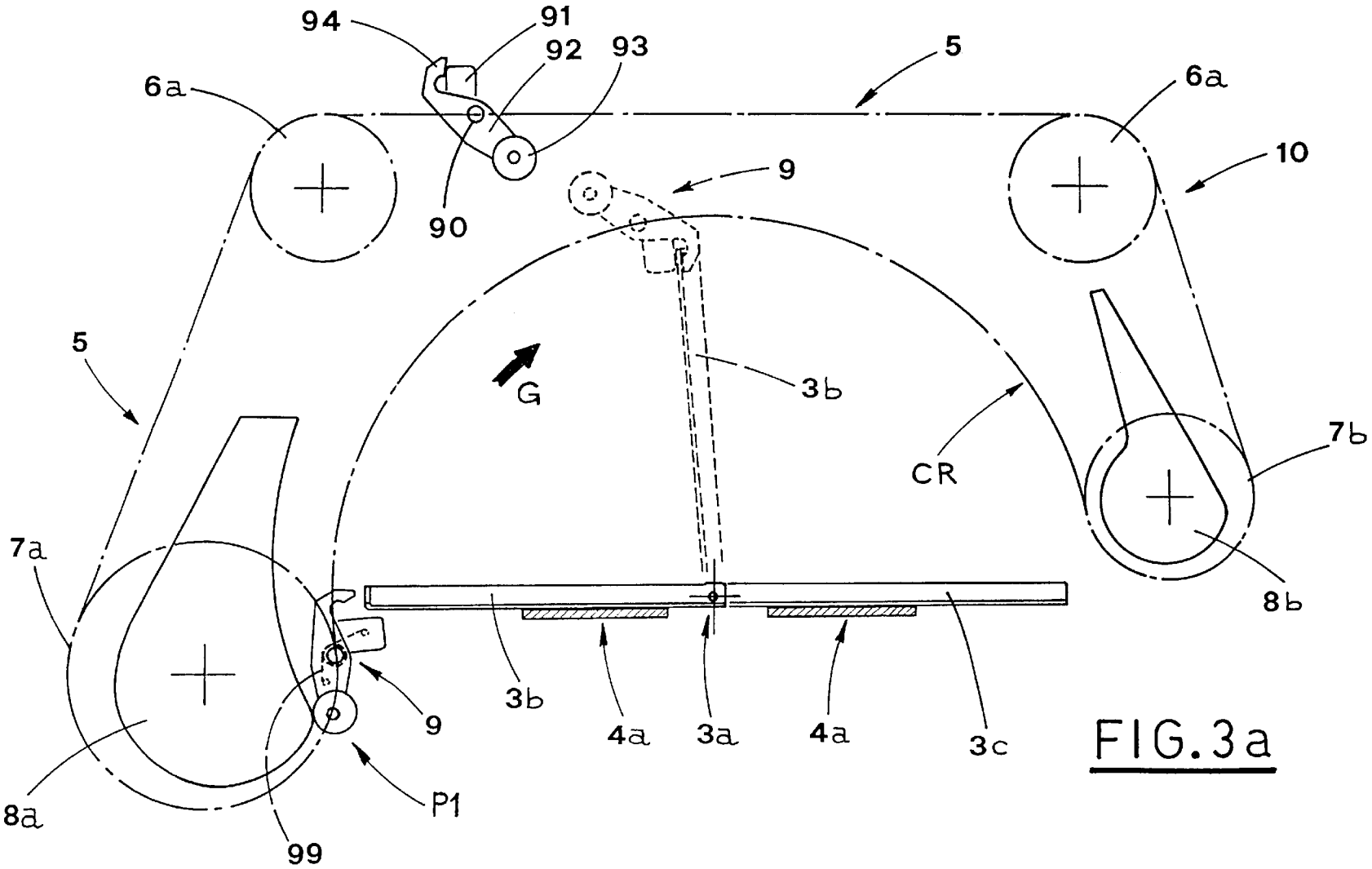
FIGS. 3*a*, 3*b* are schematic sectional views of two different operative sequences, particularly important for this device, taken along the line III—III of FIG. 1.

These book-like containers include a base 3*c* and a cover 3*b*. The cover has a shape complementary to the shape of the base and is hinged thereto along an edge 3*a*. The hinge axis 130 is shown in FIG. 3*a*.

The partial closing unit 1 is fed by a conveying line 4 operated stepwise.

The conveying line 4 includes a pair of conveying belts 4*a*, arranged side by side and supporting a series of plates 4*b* suitably spaced apart. The plates 4*b* form a series of seats for the containers 3 to be conveyed.

The containers 3, moved along the conveying line 4, change their open configuration C1, which they have upstream of the partial closing unit 1, for a partially closed configuration C2, taken immediately downstream of the partial closing unit 1.

Partially closed configuration C2 means that the edge of each cover 3*b* opposite to the hinged edges 3*a* is set close to the related base 3*c*.

A second unit 11, situated downstream of the partial closure unit 1, snaps the covers 3*b* of the containers 3 coming from the partial closure unit 1, to a completely closed condition.

Then, the conveying line 4 transports the containers 3, in the completely closed configuration, up to a packaging station downstream of the second unit 11.

The above mentioned partial closing unit 1 is supported by a hollow structure, not shown. Working means 10 are situated in the region of this hollow structure.

These working means 10 include an intermittently operated endless chain 5 mounted on guiding pulleys 6*a*, e.g. in number of two, and on first 7*a* and second 7*b* driving pulleys, one of which is powered.

The first and second driving pulleys, 7*a* and 7*b*, respectively, are situated on both sides of the conveying line 4.

In particular, the axis of the first driving pulley 7*a* is situated below the plane defined by this conveying line 4, while the axis of the second driving pulley 7*b* is situated over this plane.

Figure 3B:
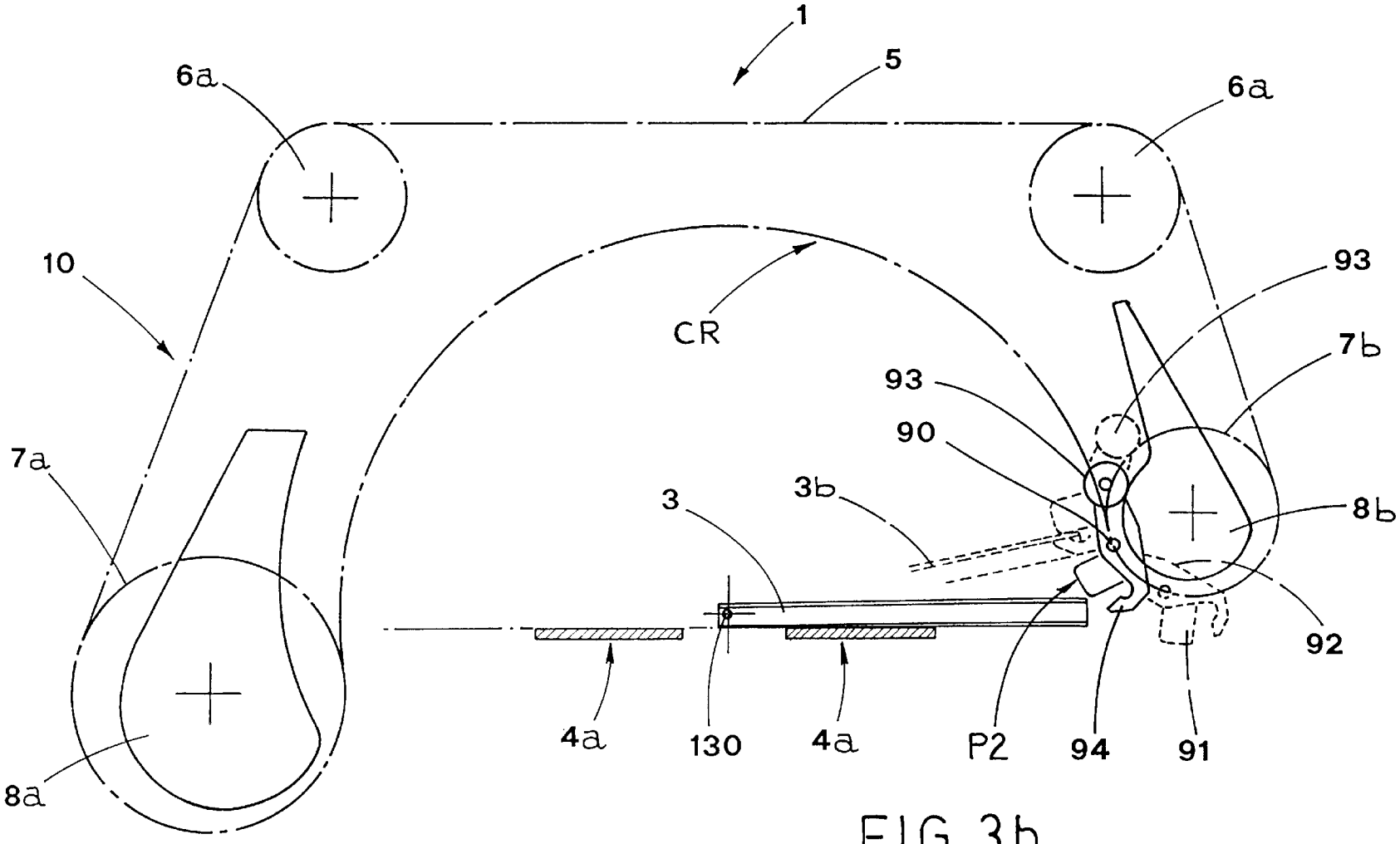

The chain 5, indicated schematically with broken line in the FIGS. 3*a*,3*b*, is suitably contained by corresponding guiding means, not shown.

The part of the chain 5 between the first driving pulley 7*a* and the second driving pulley 7*b*, follows a circular path CR, with center situated on the hinge axis 130 of the lined up edges 3*a* of the containers 3 (FIGS. 3*a*, 3*b*).

Stationary cams 8*a*,8*b*, gripping and releasing respectively, are secured to the driving pulleys first 7*a* and second 7*b*.

Gripping means 9 are pivoted to the chain 5 on an axes 90, so that they result in being located beside the chain. The distance between two following gripping means corresponds to a pre-established step.

The gripping means 9 do not interfere with the action of the above mentioned guide pulleys 6*a*, and driving pulleys 7*a* and 7*b*, first and second respectively, since they are offset, on one side of the chain.

Each one of these gripping means 9 includes substantially a rocking lever 92 pivoted at 90 by elastic means 99, such as a spring or a leaf spring, and cooperating with a stop bar 91 fastened to the chain 5 and crosswise to the lever.

At its one end, the rocking lever 92 features a hook like member 94 and on the other end it supports a roller 93.

The above mentioned elastic means keep the hook 94 in contact with the stop bar 91 until the corresponding elastic reaction is contrasted by the action of the gripping cam 8*a* and the release cam 8*b* on the rocker lever 92, via the roller 93.

Each single gripping element 9 is operated only by the relative gripping cam 8*a* and release cam 8*b*, that due to their shape move the corresponding roller 93.

The second unit 11, situated downstream of the partial closure unit 1, includes a bar 12, e.g. integral with the support structure of the conveying line 4. An arm 13 is pivoted in 23 to the bar, so that it is free to oscillate in direction Y.

The oscillation Y is controlled by a linkage 18 pivoted to the arm 13 and reciprocated vertically along X, in time relation with the gripping means 9.

At one end, opposite to the pivot 23, the arm 13 features a protrusion 14 extending towards the conveying line 4.

A feeler pin 15 is supported crosswise to the arm 13 close to the protrusion 14. The feeler pin 15 is slidably inserted in a through hole of the arm 13 so that it can slide crosswise thereto. The free end of the feeler pin 15, opposite to the conveying line 4 with respect to the arm 13, has a pair of collars 16. A proximity sensor 17 is also fastened to the arm 13 so as to be located close to the collars.

Operation of the proposed closing device will be described in the following.

Closure of the CD containers is divided in two separate steps, i.e. a partial closing step and a snap closing step.

Partial closure of the containers is performed by the partial closing unit 1, while the snapped complete closure is carried out by the second unit 11.

While a gripping element 9 is reaching gripping position P1, a container 3 in open configuration C1 passes in the region of the partial closing unit 1. The container is so arranged on the conveying line 4 that the relative hinge axis 130 lies in the center of the circular path CR of the chain 5 (FIG. 3*a*).

When the chain 5 rotates with the pivot point 90 around the gripping cam 8*a*, the roller 93 runs the convex part of the cam and is progressively moved away from tie center of the cam.

With the gripping means located in the gripping position P1, the elastic reaction of the elastic means 99 in 90 is completely balanced by the action of the gripping cam 8*a*, acting upon the roller 93 of the gripping element 9.

Consequently, the hook 94 is brought to the maximum distance from the relative stop bar 91.

With continuation of the motion of the chain 5, the roller 93 of the gripping element 9 slides on the concave portion of the gripping cam 8*a*, whose shape allows the hook 94 of the rocker lever 92 to progressively approach the relative stop bar 91.

This approaching determines consequent blocking of the relative edge of the cover 3*b* of the container 3 between the stop bar 91 and the hook 94.

After the roller 93 has been moved away from the gripping cam 8*a*, the cover 3*b* of the container 3 is kept gripped due to the elastic reaction of the elastic means 99 in 90.

To better explain it, this elastic reaction keeps the hook 94 urged against the relative stop bar 91.

With the gripping element 9 moving away from the gripping position P1, the cover 3*b* of the container 3 is rotated in direction G (FIG. 3*a*).

Rotation of the cover 3*b* in direction G is always pre-formed around the hinge axis 130 of the relative edge 3*a*, therefore, with respect to the rotation center of the circular trajectory CR of the chain 5.

When the cover 3*b* of the container 3 is about to get close to the relative base 3*c*, the roller 93 comes to touch the release cam 8*b*, thus provoking loading of the elastic means present in 90.

The release cam 8*b* is shaped in such a way as to cause a gradual moving of the hook 94 away from the relative stop bar 91. Consequently, the cover 3*b* of the container 3 is released from the gripping element 9 in the release position P2.

The cover 3*b* of the container 3 is left resting on the related base 3*c* at the end of the partial closure step, during which the base 3*c* has been always kept touching the conveying belt 4*a*.

At the same time, also an advancement cycle of the transmission means 5 is completed, which is therefore defined by the passage of any gripping element 9, from the gripping position P1 to the release position P2.

A subsequent gripping element 9 is taken to the gripping position P1 in time relation with the release of the cover 3*b* of the container 3 from the previously considered gripping element 9. Meanwhile, the Conveying line 4 advances synchronously until a subsequent container 3, in open configuration C1, is carried to the partial closure unit 1.

The partially closed container 3 is moved, in time relation with the synchronous advancement of the conveying line 4, to the subsequent second unit, situated downstream of the partial closure unit 1.

Snap closing of the container 3 begins with the movement of the linkage 18 in direction X, that makes the arm 13 oscillate in direction Y until the corresponding protrusion 14 touches the container 3.

The protrusion 14 pushes the cover and the container 3 is snapped to be completely closed.

Figure 4:
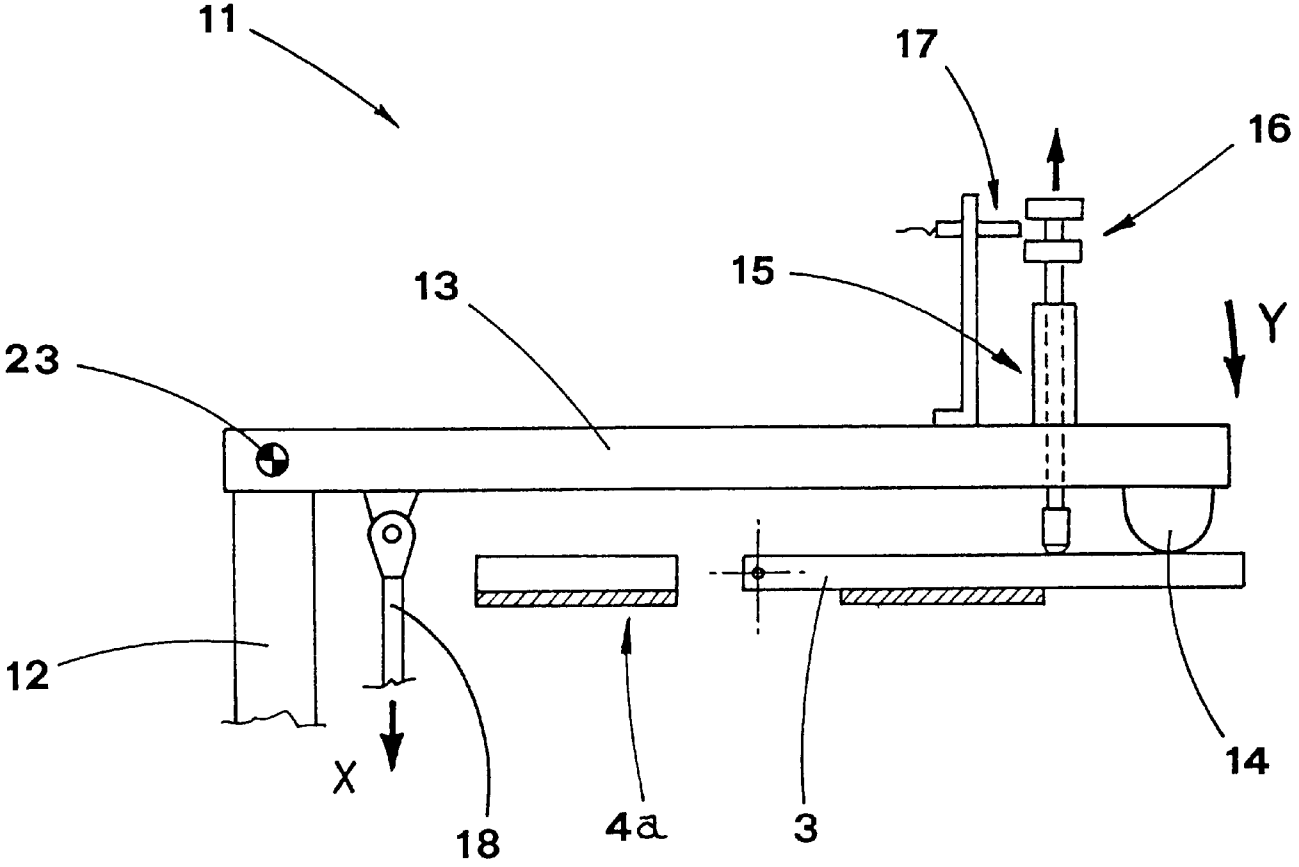
FIG. 4 is a schematic sectional view taken along the line IV—IV of FIG. 1.

The feeler pin 15 verifies the snap closure of the container 3, when the linkage 18 is operated, by means of the sensor 17, that detects the presence of the collars 16, and commands rejection of the container if the result is negative (FIG. 4).

The described partial closure unit 1 guarantees a rapid and precise partial closure, characterized by high reliability standard.

Moreover, the gripping elements 9, which rotate the cover 3*b* of the container 3 until it rests on the relative base 3*c*, allow the partial closure step to be particularly stable and substantially without destabilizing impacts.

The subsequent snap closure step, performed by the second unit 11 action, does not provoke additional complications, since it is particularly rapid and efficient.

Moreover, it is to be pointed out that the components of the closing device for book-like containers are simple to manufacture and their number is limited, which leads to lower production costs.

These advantages have been obtained by means of a technical solution which is simple, extremely reliable and practical, and allows to optimize a subsequent packaging step.

It is understood that what above has been described as a mere, non limitative example, therefore possible constructive variants remain within the protective scope of the present technical solution, as described above and claimed in the following.

What is claimed is:

1. A closing device for book-like containers, each container formed by a base and a cover having a shape complementary to said base, said cover being hinged to said base along an edge of said base and having a hinge axis, said containers being advanced stepwise in an open configuration in a forward direction along a conveying line, the hinge axis aligned and parallel to said forward direction of the conveying line, said closing device comprising:

a first unit for partially closing said containers, said first unit including gripping means for gripping an open end cover of a container, the first unit operated over said conveying line in time relation with the step advance of said conveying line, the gripping means moved over a circular path having a center coaxial with a hinge axis of a container having an open cover situated below the first unit, the container oriented so that a closing rotation direction of said cover coincides with a rotation direction of said gripping means, such that the open cover is gripped by the gripping means and rotated in the closing rotation direction;

activation means located in a gripping position for closing said gripping means to engage an outer edge of said open cover;

deactivation means located in a release position for opening said gripping means to release said outer edge of said rotated cover in a position near to said base, to obtain a partially-closed container; and a second unit situated downstream of said first unit along said conveying line for snap-closing said cover of said partially-closed container received from said first unit.

2. A device, according to claim 1, wherein said gripping means are supported and operated by guiding pulleys and first and second driving pulleys, at least one of said driving pulleys being powered, said pulleys being connected by an endless link element fastened to guide means, said gripping means laterally hinged to said endless line element, said gripping means having a relative pivot axis parallel to the hinge axes of the containers.

3. A device, according to claim 2, wherein each said gripping means includes a stop bar, fastened to said endless link element, and a rocker lever, pivoted on the same endless link element, elastic means for biasing said rocker lever, said rocker lever supporting an idle roller at one end opposite to said stop bar, and having another end facing said stop bar, a hook for cooperating with said stop bar to engage and release said outer edge of the cover of said container in response to said activation means and deactivation means.

4. A device, according to claim 2, wherein each said gripping means includes a stop bar, fastened to said endless link element, and a rocker lever, pivoted on the same endless link element with interposition of elastic means, with this rocker lever supporting an idle roller at one end opposite to said stop bar, and featuring at another end facing said stop bar, a hook which cooperate with said stop bar to engage and release said outer edge of the cover of each container due to the action of said activation means and deactivation means performed on said roller.

5. A device, according to claim 3, wherein said activation means and deactivation means include stationary cams connected respectively to said first and second driving pulleys.

6. A device, according to claim 1, wherein said second unit includes:

an arm with one end pivoted on a stationary bar and another end having a protrusion turned towards said containers, said arm being operated by a linkage moved vertically;

a feeler pin fastened to the arm and situated near the protrusion, a pair of collars a sensor being integral with said arm and aimed at detecting the snap closure of the covers of said containers.

7. A device, according to claim 4, wherein said elastic means include a spring hooked to said stop bar and to said rocker lever.

8. A device, according to claim 7, wherein said spring is a leaf spring.

* * * * *